US009227807B2

(12) United States Patent
Watanabe

(10) Patent No.: US 9,227,807 B2
(45) Date of Patent: Jan. 5, 2016

(54) SHEET PROCESSING APPARATUS AND IMAGE FORMING APPARATUS

(71) Applicant: CANON KABUSHIKI KAISHA, Tokyo (JP)

(72) Inventor: Kiyoshi Watanabe, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/537,459

(22) Filed: Nov. 10, 2014

(65) Prior Publication Data

US 2015/0175378 A1 Jun. 25, 2015

(30) Foreign Application Priority Data

Dec. 25, 2013 (JP) ..... 2013-267107

(51) Int. Cl.
*B65H 9/00* (2006.01)
*B65H 1/28* (2006.01)

(52) U.S. Cl.
CPC .. *B65H 9/00* (2013.01); *B65H 1/28* (2013.01); *B65H 2301/33* (2013.01); *B65H 2402/10* (2013.01); *B65H 2801/24* (2013.01)

(58) Field of Classification Search
CPC ..... B65H 9/00; B65H 9/04; B65H 9/08; B65H 9/101; B65H 2301/33; B65H 2301/511; B65H 2301/515; B65H 2301/5151; B65H 2301/5152; B65H 2402/10; B65H 2801/24; B65H 2801/27
USPC ..... 271/226, 227, 234, 240, 248, 250
See application file for complete search history.

(56) References Cited

U.S. PATENT DOCUMENTS

| | | | | |
|---|---|---|---|---|
| 7,866,645 | B2 | 1/2011 | Fujita et al. | |
| 8,226,078 | B2 | 7/2012 | Watanabe et al. | |
| 8,231,120 | B2 | 7/2012 | Hayashi et al. | |
| 8,302,951 | B2 | 11/2012 | Watanabe et al. | |
| 2006/0145415 | A1* | 7/2006 | Oota et al. | 271/264 |
| 2006/0163801 | A1* | 7/2006 | Dejong et al. | 271/227 |
| 2007/0051219 | A1 | 3/2007 | Tamura et al. | |
| 2007/0273091 | A1* | 11/2007 | Kamiya et al. | 271/233 |
| 2009/0033028 | A1* | 2/2009 | Yahata et al. | 271/259 |
| 2010/0264580 | A1* | 10/2010 | Saltsov et al. | 271/240 |
| 2011/0101591 | A1* | 5/2011 | Sano et al. | 270/20.1 |
| 2011/0215517 | A1* | 9/2011 | Mizutani et al. | 271/109 |
| 2011/0285072 | A1* | 11/2011 | Yokoya et al. | 270/58.07 |
| 2012/0025438 | A1* | 2/2012 | Fukatsu et al. | 270/58.07 |
| 2013/0026707 | A1* | 1/2013 | Iwata et al. | 271/227 |
| 2013/0082436 | A1* | 4/2013 | Gamo | 271/34 |
| 2013/0266358 | A1* | 10/2013 | Nowak et al. | 400/621 |
| 2013/0270766 | A1* | 10/2013 | Kashiba et al. | 271/227 |
| 2013/0300055 | A1* | 11/2013 | Ishikawa et al. | 271/227 |
| 2014/0015188 | A1* | 1/2014 | Tokuma et al. | 270/58.12 |
| 2014/0042686 | A1* | 2/2014 | Konishi et al. | 270/58.31 |
| 2015/0063952 | A1* | 3/2015 | Kawai | 412/19 |

* cited by examiner

*Primary Examiner* — David H Bollinger
(74) *Attorney, Agent, or Firm* — Fitzpatrick, Cella, Harper & Scinto

(57) ABSTRACT

A sheet processing apparatus includes: a conveying roller that conveys a sheet; a lateral registration skew correcting unit that corrects a position in a width direction orthogonal to a sheet conveying direction, of the sheet conveyed by the conveying roller; and a sheet processing portion that performs processing on the sheet conveyed by the conveying roller. A plurality of types of sheet processing portions is replaceable, and the sheet processing apparatus includes a puncher controller that changes an operation of the lateral registration skew correcting unit according to the type of the sheet processing portion.

17 Claims, 18 Drawing Sheets

SHEET PROCESSING APPARATUS AND IMAGE FORMING APPARATUS

BACKGROUND OF THE INVENTION

1. Field of the Invention

The present invention relates to a sheet processing apparatus that processes a sheet and an image forming apparatus having the same.

2. Description of the Related Art

A sheet processing apparatus disclosed in U.S. Patent Application Publication No. 2007/051219 A1 includes an attitude correcting portion that corrects print skew and aligns a leading edge of a sheet by allowing the leading edge to bump against something and a punching portion having a punch that performs a punching process on the sheet. The sheet processing apparatus further includes a lateral registration adjustment portion which can adjust the position of the punch of the punching portion in relation to the sheet of which the attitude is corrected by the attitude correcting portion in a direction vertical to a moving direction of the sheet before the punching portion performs the punching process.

A sheet processing apparatus having such a configuration that a punching portion is detachably attached to a fixed support having a driving source of the lateral registration adjustment portion and the type of the punching portion can be recognized when the punching portion is attached. Due to this, the sheet processing apparatus can be easily replaced according to punching conditions such as a punch hole and the number of holes and can automatically recognize set conditions and alignment during replacement.

In a sheet processing apparatus in which a punching portion can be replaced, the punching portion may be replaced with a scoring portion to cut lines in a sheet or may be replaced with a perforating portion to make perforations.

However, since it is necessary to press a convex and concave mold with uniform force in a sheet width direction in order to cut lines uniformly in the sheet, large processing force is required as compared to punching which can decrease processing force by punching with a time difference.

Due to this, since it is necessary to decrease a rotating velocity of a motor which is a driving source to increase torque, the processing time increases. As a result, productivity decreases. The same problem occurs in the perforating portion since the perforating portion performs processing in the entire sheet width direction.

The present invention has been made in view of the problem and it is desirable to provide a sheet processing apparatus of which the productivity is not impaired by a sheet processing portion.

SUMMARY OF THE INVENTION

According to a representative aspect of the present invention, there is provided a sheet processing apparatus including: a sheet conveying portion that conveys a sheet; a position correcting portion that corrects a position in a width direction orthogonal to a sheet conveying direction, of the sheet conveyed by the sheet conveying portion; and a sheet processing portion that performs processing on the sheet conveyed by the sheet conveying portion. A plurality of types of sheet processing portions is replaceable, and the sheet processing apparatus includes a controller that changes an operation of the position correcting portion according to the type of the sheet processing portion.

Further features of the present invention will become apparent from the following description of exemplary embodiments with reference to the attached drawings.

DESCRIPTION OF THE EMBODIMENTS

An embodiment of an image forming apparatus having a sheet processing apparatus according to the present invention will be described in detail with reference to the drawings.

<Image Forming Apparatus>

Figure 1:
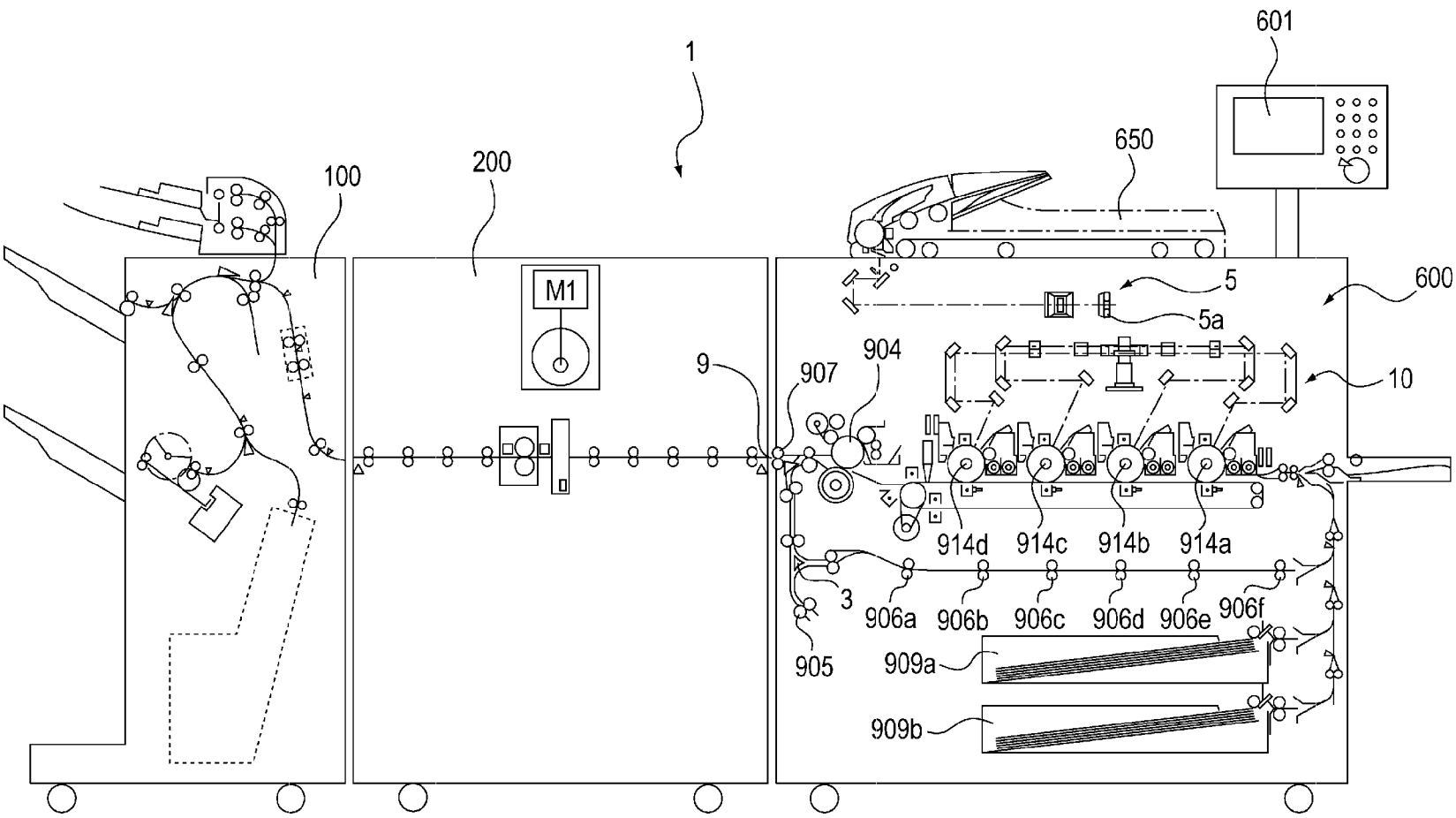
FIG. 1 is a cross-sectional explanatory view illustrating a configuration of an image forming apparatus having a sheet processing apparatus according to the present invention.

FIG. 1 is a cross-sectional explanatory view illustrating a configuration of an image forming apparatus having a sheet processing apparatus according to the present invention. As illustrated in FIG. 1, an image forming apparatus 1 includes an image forming apparatus main body 600 that forms monochrome or color images and a puncher 200 and a finisher 100 connected to the image forming apparatus main body 600.

Thus, a sheet 2 discharged from the image forming apparatus main body 600 can be processed by the puncher 200 and the finisher 100 connected online. The image forming apparatus main body 600 can be used standalone without the finisher 100 connected to a discharge port 9.

Moreover, the image forming apparatus main body 600 may incorporate the puncher 200 and the finisher 100 integrally as a sheet discharging device. Here, a position where a user faces an operation portion 601 in order to input or set various types of information to the image forming apparatus main body 600 is referred to as a frontal front side (hereinafter, front side) of the image forming apparatus 1, and an apparatus rear side is referred to as a back side.

FIG. 1 illustrates a configuration of the image forming apparatus 1 when seen from an apparatus front side. The puncher 200 and the finisher 100 are connected to a lateral portion of the image forming apparatus main body 600.

Toner images of the four colors yellow, magenta, cyan, and black are transferred to the sheet 2 supplied from a sheet cassette 909*a* or 909*b* in the image forming apparatus main body 600 by photosensitive drums 914*a* to 914*d* or the like, which serve as image bearing members. The photosensitive drums 914*a* to 914*d* form image forming portions that form toner images on the sheet 2.

The sheet 2 is conveyed to a fixing device 904 and the toner images are fixed thereto. In a single-side print mode, the sheet 2 is directly discharged outside the image forming apparatus main body 600 from a discharge roller 907.

In a duplex print mode, the sheet 2 is delivered from the fixing device 904 to a reversing roller 905. The reversing roller 905 rotates in a reverse direction when the rear end in a conveying direction of the sheet 2 exceeds a reversing flapper 3. In this way, the sheet 2 is conveyed in a direction toward duplex conveying rollers 906*a* to 906*f*, which is opposite to the sheet conveying direction.

Toner images of four colors are transferred to a rear surface side of the sheet 2 again by the yellow, magenta, cyan, and black photosensitive drums 914*a* to 914*d* and the like. The sheet 2 in which the toner images are transferred to both sides thereof is conveyed to the fixing device 904 again, and the toner images are fixed. After that, the sheet 2 is discharged outside the image forming apparatus main body 600 by the discharge roller 907.

<Controller>

Figure 2:
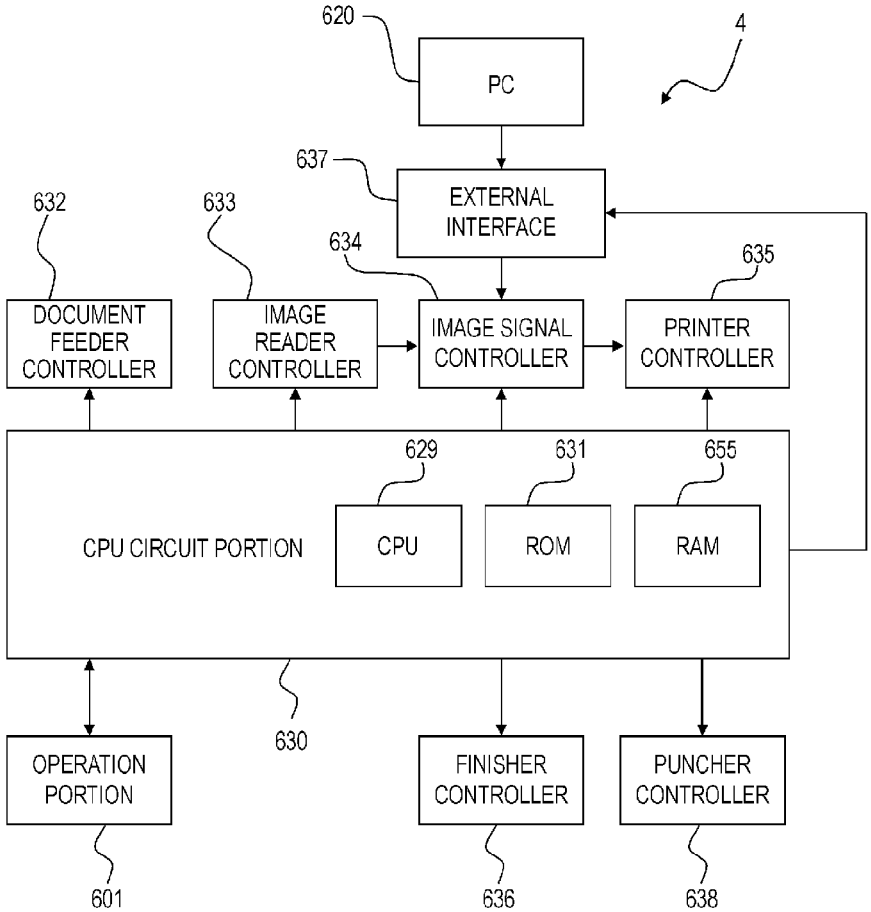
FIG. 2 is a block diagram for describing a configuration of a control system of the image forming apparatus having the sheet processing apparatus according to the present invention.

FIG. 2 is a block diagram illustrating a configuration of a controller 4 that controls the image forming apparatus 1. In FIG. 2, a central processing unit (CPU) circuit portion 630 includes a CPU 629, a read only memory (ROM) 631, a random access memory (RAM) 655.

The CPU circuit portion 630 controls a document feeder controller 632, an image reader controller 633, an image signal controller 634, a printer controller 635, a finisher controller 636, a puncher controller 638 serving as a controller, and an external interface 637.

The CPU circuit portion 630 performs control according to the setting of the operation portion 601 and a program stored in the ROM 631. The document feeder controller 632 controls a document feeder 650. The image reader controller 633 controls an image reader 5.

The printer controller 635 controls the image forming apparatus main body 600. The puncher controller 638 controls the puncher 200 serving as a sheet processing portion that performs predetermined processing on the sheet 2 conveyed by a conveying roller 211 which serves as a sheet conveying portion illustrated in FIG. 3.

The finisher controller 636 controls the finisher 100. In the present embodiment, a configuration in which the puncher controller 638 is mounted on the puncher 200 and the finisher controller 636 is mounted on the finisher 100 will be described.

The present invention is not limited to this, and the puncher controller 638 and the finisher controller 636 may be provided in the image forming apparatus main body 600 integrally with the CPU circuit portion 630 so that the puncher 200 and the finisher 100 are controlled by the image forming apparatus main body 600.

The RAM 655 is used as an area for temporarily storing control data and a work area for operations associated with control. The external interface 637 is an interface from a personal computer (PC) 620, develops print data to create an image and outputs the image to the image signal controller 634.

An image read by an image sensor 5*a* is output from the image reader controller 633 to the image signal controller 634. The image output from the image signal controller 634 to the printer controller 635 is input to an exposure controlling portion (not illustrated) that controls a laser scanner 10 that serves as an image exposing portion.

The puncher controller 638 is mounted on the puncher 200 and controls the driving of the entire puncher 200 by exchanging information with the CPU circuit portion 630 of the image forming apparatus 1. The finisher controller 636 is mounted on the finisher 100 and controls the driving of the entire finisher 100 by exchanging information with the CPU circuit portion 630 of the image forming apparatus 1. The puncher controller 638 and the finisher controller 636 controls various motors, sensors, and the like provided in the image forming apparatus 1.

<Puncher>

Figure 3:
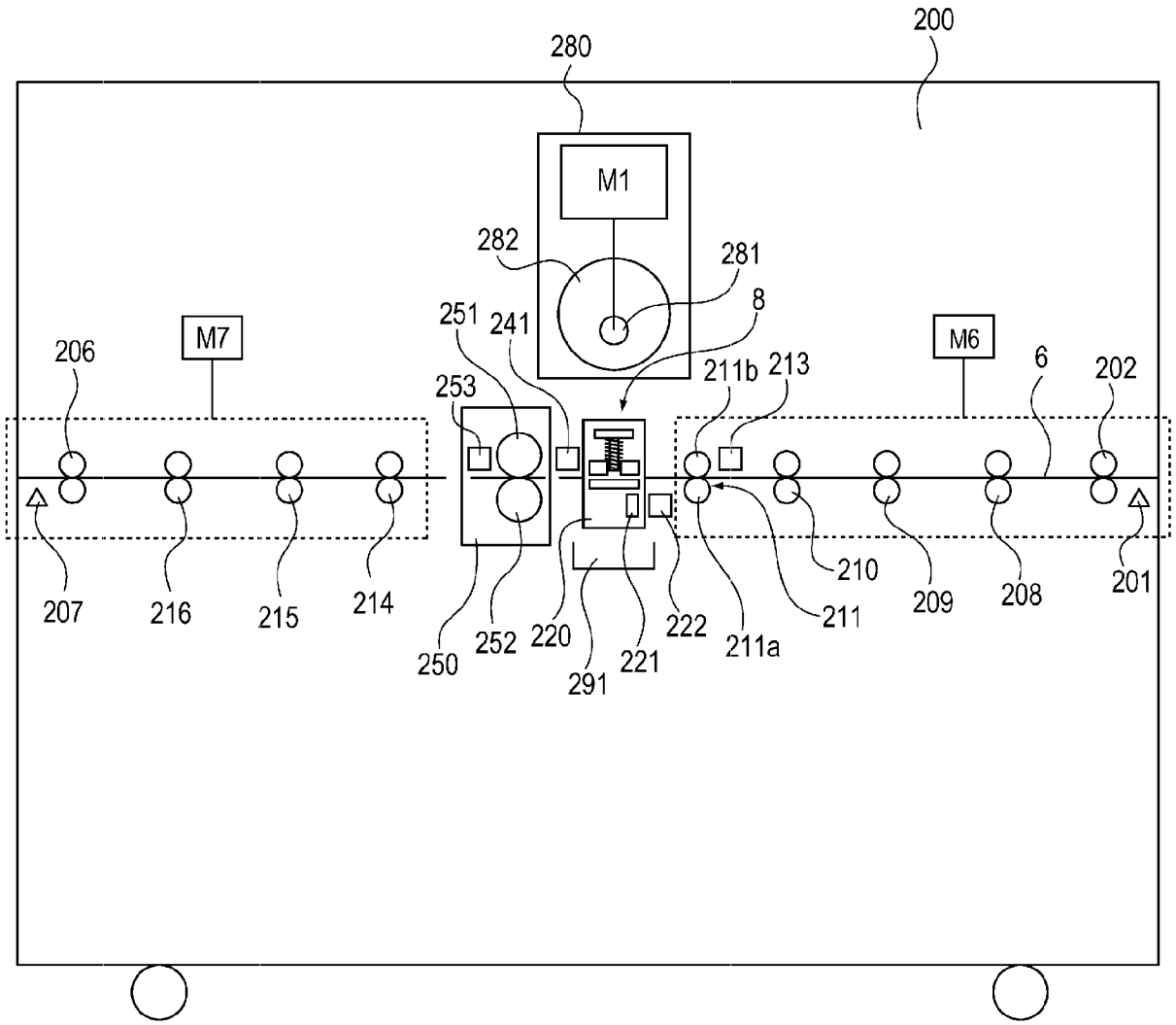
FIG. 3 is a cross-sectional explanatory view illustrating a configuration of a puncher of the sheet processing apparatus according to the present invention.

FIG. 3 is a cross-sectional view of the puncher 200. The puncher 200 sequentially receives the sheets 2 discharged from the discharge port 9 of the image forming apparatus main body 600. Then, the puncher 200 performs a punching process to make holes in the received sheet 2. Alternatively, the puncher 200 includes a punch path 6 in which a scoring process is performed to cut lines in the sheet 2.

The sheet processing in the puncher 200 operates according to the setting of the user with the aid of the operation portion 601 provided in the image forming apparatus main body 600. The sheet 2 discharged from the discharge port 9 of the image forming apparatus main body 600 is delivered to the conveying roller 202 of the puncher 200. In this case, a delivery timing of the sheet 2 is also detected by an entrance sensor 201.

The sheet 2 is conveyed to a processing portion 8 by conveying rollers 208 to 211. Moreover, the sheet 2 passes through a conveying path 232 of a punch unit 220 illustrated in FIGS. 3 and 5. Moreover, the attitude of the sheet 2 is corrected by a lateral registration skew correcting unit 250 serving as a position correcting portion that corrects the position in a width direction orthogonal to the sheet conveying direction of the sheet 2 which is nipped and conveyed by the conveying roller which includes active rollers 251*a* and 251*b* and follower rollers 252*a* and 252*b* illustrated in FIG. 11.

After the sheet 2 stops at a predetermined position in the sheet conveying direction, a press driving unit 280 serving as a driving portion that drives the punch unit 220 serving as a punching portion which is a sheet processing portion and makes holes in the sheet 2 operates the punch unit 220 to make holes in the sheet 2.

The sheet 2 in which holes are formed by the punch unit 220 is nipped and conveyed by the conveying roller 211 again and is further conveyed by conveying rollers 214 to 216 and 206 to be delivered to the finisher 100 on the downstream side.

A plurality of punch units 220 is prepared as a plurality of kinds of sheet processing portions configured to form different numbers of holes having different hole shapes and the punch unit 220 is mounted so as to be appropriately replaced. A unit identification sensor 222 reads type information stored in a storage portion of an integrated circuit (IC) chip 221 serving as a storage portion mounted on the punch unit 220.

In this way, the type of the punch unit 220 mounted on the processing portion 8 is identified. Alternatively, specifically, whether a scoring unit 300 (described later) serving as a scoring portion that performs scoring to cut lines in the sheet 2 is mounted on the processing portion 8 is identified. Alternatively, whether a perforation unit 400 that makes perforations in the sheet 2 is mounted on the processing portion 8 is identified. Alternatively, whether a cutting unit 500 that cuts the sheet 2 is mounted on the processing portion 8 is identified. Alternatively, whether a stamping unit 800 that stamps marks or the like on the sheet 2 is mounted on the processing portion 8 is identified. The configuration of the respective processing units will be described later.

Figure 4:
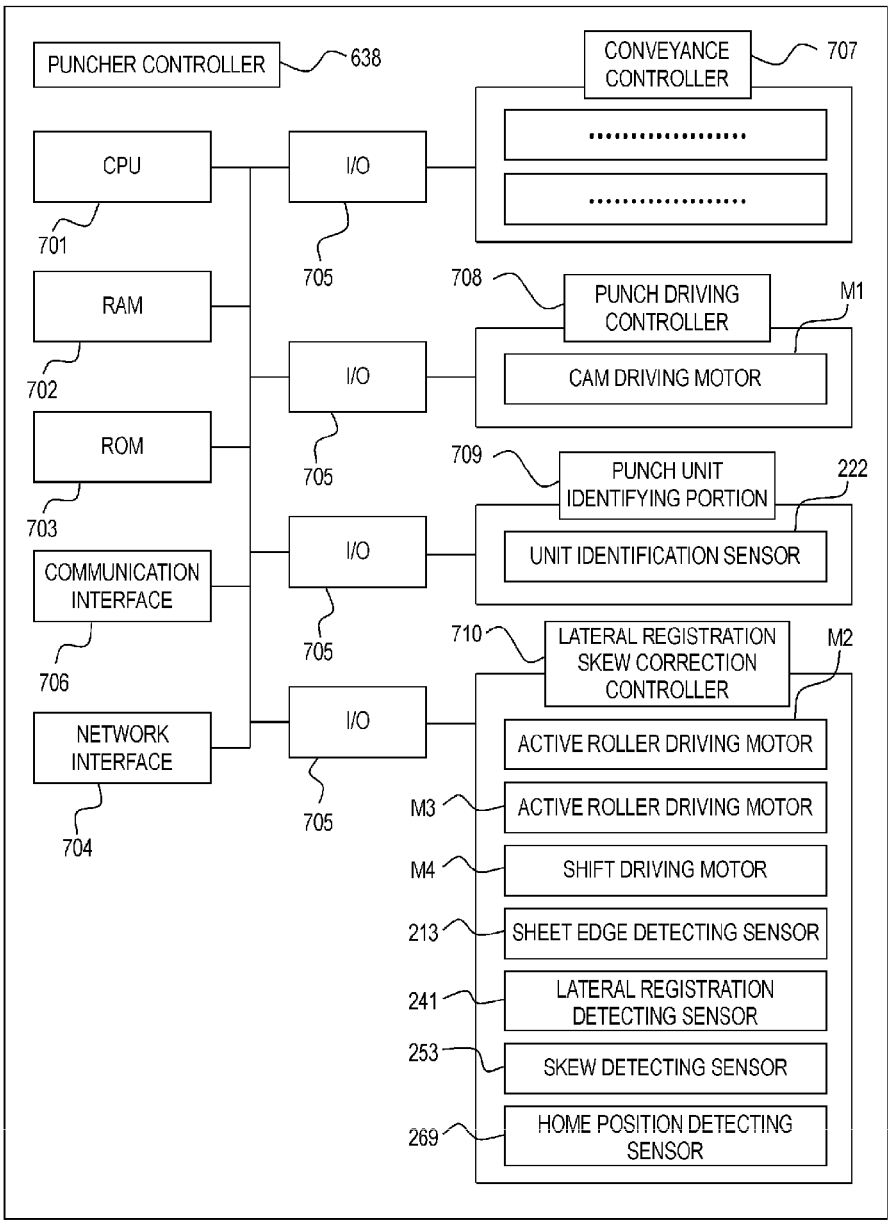
FIG. 4 is a block diagram illustrating a configuration of a control system of the puncher.

As illustrated in FIG. 4, the puncher controller 638 has a central processing unit (CPU) 701 that includes a microcomputer. Further, the puncher controller 638 includes a random access memory (RAM) 702 and a read only memory (ROM) 703. Further, the puncher controller 638 includes an input/output (I/O) interface 705 serving as an input-output portion, a communication interface 706, and a network interface 704.

A conveyance controller 707 controls conveying of the sheet 2. Moreover, a punch driving controller 708 controls a cam driving motor M1 to rotate a cam 282. A punch unit identifying portion 709 reads type information stored in a storage portion of the IC chip 221 serving as a storage portion incorporated into the punch unit 220 to thereby identify the type of the punch unit 220 mounted.

The punch unit identifying portion 709 also identifies another processing unit such as the scoring unit 300 as well as the punch unit 220 based on a signal from the unit identification sensor 222.

Figure 11:
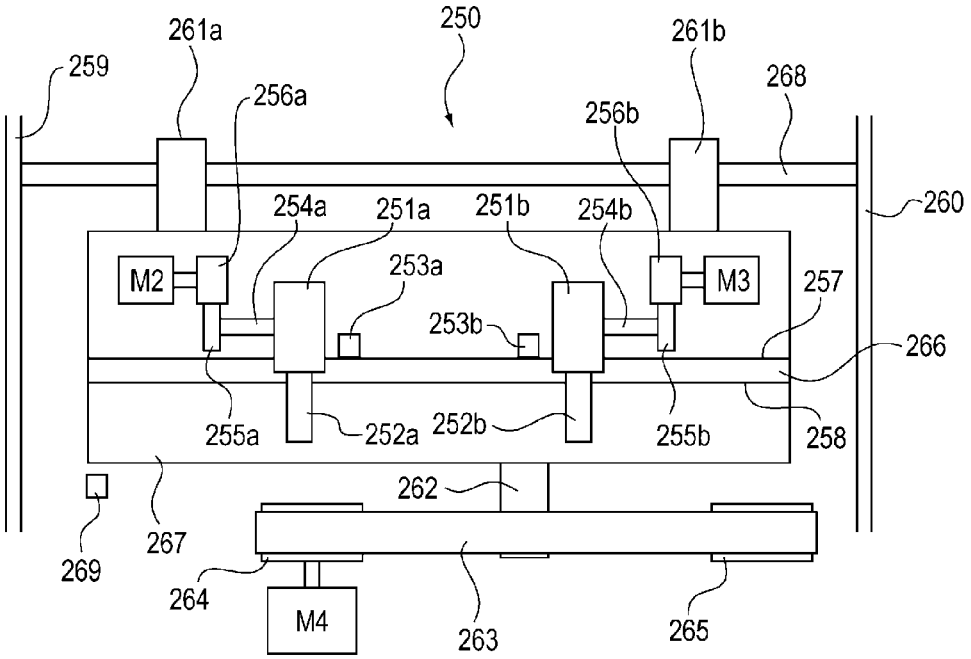
FIG. 11 is a view of a lateral sheet registration correcting portion of the sheet processing apparatus according to the present invention when seen from the downstream side in a sheet conveying direction.

In a lateral registration skew correction controller 710, a home position detecting sensor 269 and a shift driving motor M4 control a shift portion 267 illustrated in FIG. 11 and active roller driving motors M2 and M3 control an active roller 251. Various sensor signals are input to an input port of the I/O interface 705. A control block (not illustrated) and various driving systems connected via various drivers (not illustrated) are connected to an output port of the I/O interface 705.

<Punch Unit>

Figure 5:
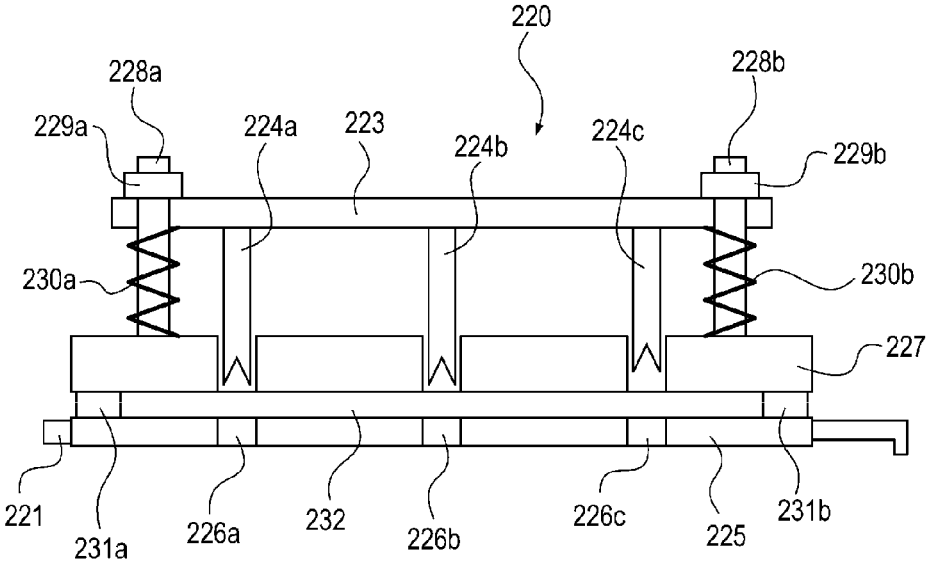
FIG. 5 is a cross-sectional explanatory view illustrating a configuration of a punch unit of the sheet processing apparatus according to the present invention.

FIG. 5 is a cross-sectional view of the punch unit 220 when seen from the downstream side in the sheet conveying direction. Punch blades 224*a* to 224*c* are attached to a movable plate 223. Die holes 226*a* to 226*c* are formed in a die plate 225. When the sheet 2 moves through the conveying path 232 formed by a conveyance guide 227 of the punch unit 220, the punch blades 224*a* to 224*c* fixed to the movable plate 223 move downward from the upper side of FIG. 5. When the punch blades 224*a* to 224*c* engage with the die holes 226*a* to 226*c*, holes are formed in the sheet 2 by the punch blades 224*a* to 224*c*.

The die plate 225 and the conveyance guide 227 are in such a positional relation as to form the conveying path 232 with spacers 231*a* and 231*b* interposed therebetween. Moreover, the conveyance guide 227 also performs the role of a guide that guides the punch blades 224*a* to 224*c* to the die holes 226*a* to 226*c* that faces the punch blades 224*a* to 224*c*, respectively.

Figure 6:
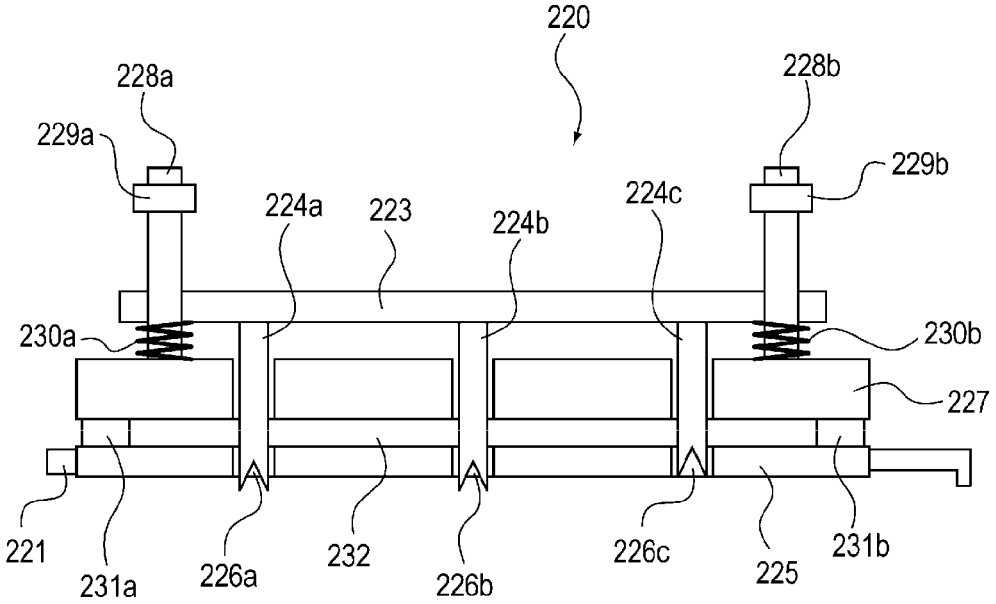
FIG. 6 is a cross-sectional explanatory view illustrating how the punch unit punches holes in a sheet.

The movable plate 223 is supported by shaft guides 228*a* and 228*b*. As illustrated in FIG. 6, the movable plate 223 is pressed by the cam 282 illustrated in FIG. 3. In this way, the punch blades 224*a* to 224*c* engage with the die holes 226*a* to 226*c* and holes can be formed in the sheet 2 present in the conveying path 232.

The release springs 230*a* and 230*b* are springs that push up the pressed movable plate 223 and a top dead point of the movable plate 223 is at a position where the movable plate 223 abuts stoppers 229*a* and 229*b*. The punch blades 224*a* to 224*c* have slightly different lengths from an attachment surface of the movable plate 223 and sequentially engage with the die holes 226*a* to 226*c*. In this way, the load when making holes in the sheet 2 is decreased.

FIG. 5 is an example of a three-hole punch unit 220 for making three holes in the sheet 2. Besides this, various punch units 220 having two holes, four holes, and a larger number of holes are also applicable. The type information is written and stored in the storage portion of the IC chip 221 serving as a storage portion so that the type of the punch unit 220 can be identified. When the unit identification sensor 222 of the puncher 200 reads the type information of the punch unit 220, it is possible to identify which type of the punch unit 220 is mounted on the processing portion 8.

<Scoring Unit>

Figure 7:
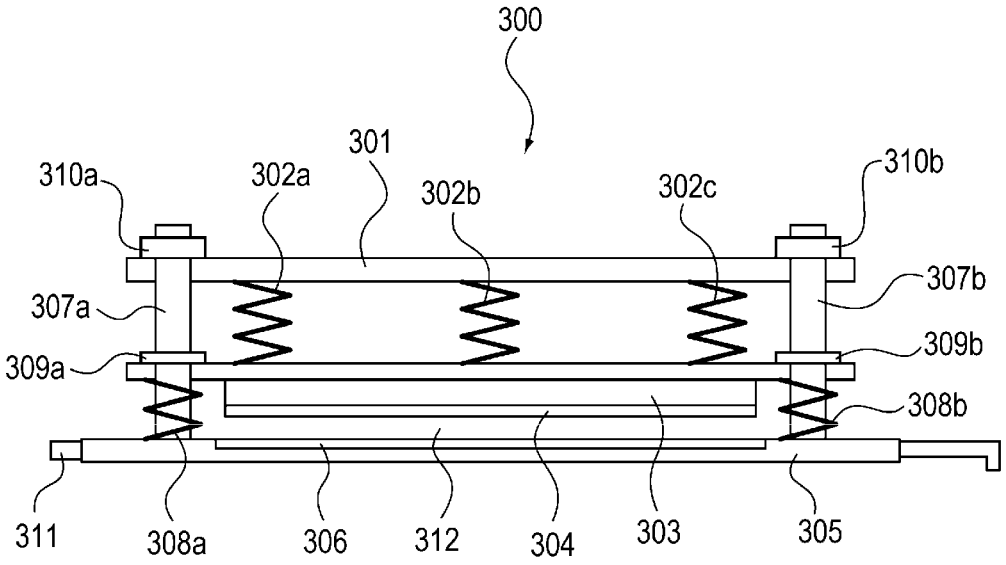
FIG. 7 is a cross-sectional explanatory view illustrating a configuration of a scoring unit of the sheet processing apparatus according to the present invention.
Figure 8:
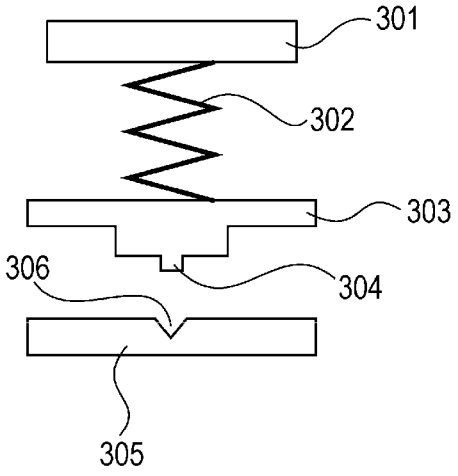
FIG. 8 is a cross-sectional explanatory view when the scoring unit is seen from a front side.

FIG. 7 is a cross-sectional view of the scoring unit 300 when seen from the downstream side in the sheet conveying direction. FIG. 8 is a view when the scoring unit 300 is seen from the apparatus front surface. A die plate 305 has a scoring groove 306. Shaft guides 307*a* and 307*b* are provided on the die plate 305, and a movable plate 301 and a blade plate 303 are supported so as to be slidable along the shaft guides 307*a* and 307*b*.

Figure 10:
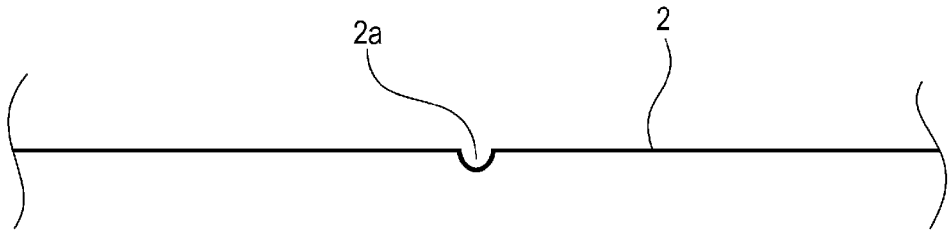
FIG. 10 is a cross-sectional explanatory view illustrating a sheet in which a line is cut by the scoring unit.

A scoring blade 304 is provided on the blade plate 303 and is configured to engage with the scoring groove 306 to cut lines in the sheet 2. FIG. 10 illustrates a cross-section of the sheet 2 in which a line is cut by the scoring blade 304. A scored portion 2*a* is formed in the sheet 2 by the scoring blade 304.

Figure 9:
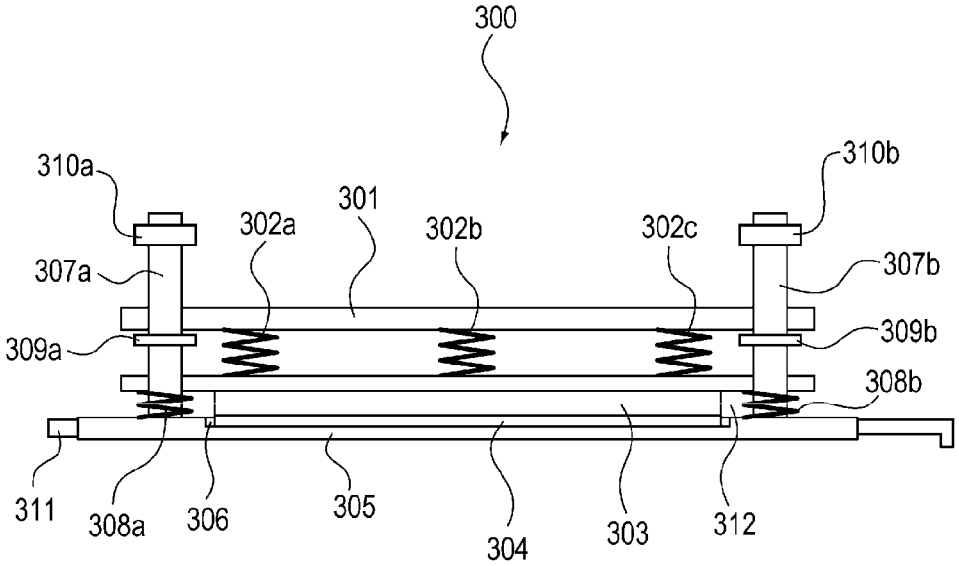
FIG. 9 is a cross-sectional explanatory view illustrating how the scoring unit cuts lines in a sheet.

Pressing springs 302*a* to 302*c* are provided between the movable plate 301 and the blade plate 303. The movable plate 301 is supported by the shaft guides 307*a* and 307*b*. As illustrated in FIG. 9, the movable plate 301 is pressed by the cam 282 illustrated in FIG. 3. In this way, the blade plate 303 is pressed by extension force of the pressing springs 302*a* to 302*c* and the scoring blade 304 engages with the scoring groove 306. In this way, lines can be cut in the sheet 2 present in the conveying path 312.

Release springs 308*a* and 308*b* are springs that push up the pressed blade plate 303. A top dead point of the blade plate 303 is at a position where the blade plate 303 abuts stoppers 309*a* and 309*b*, and a top dead point of the movable plate 301 is at a position where the movable plate 301 abuts stoppers 310*a* and 310*b*.

Uniform force is applied to an entire area in the sheet width direction of the scoring blade 304 when the scoring blade 304 engages with the scoring groove 306. Due to this, larger force is required for the scoring process as compared to when holes are formed in the sheet 2 sequentially by the punch blades 224*a* to 224*c* illustrated in FIG. 6.

In the scoring unit 300, the type information is written and stored in the storage portion of an IC chip 311 serving as a storage portion for identifying the type of the scoring unit 300. When the unit identification sensor 222 of the puncher 200 reads the type information of the scoring unit 300, it is possible to identify the scoring unit 300 mounted on the processing portion 8.

<Punch Driving Portion>

The press driving unit 280 of FIG. 3 includes the cam 282 that presses an upper surface of the movable plate 223 of the punch unit 220 or an upper surface of the movable plate 301 of the scoring unit 300. Further, the press driving unit 280 includes a cam shaft 281 and the cam driving motor M1 that rotates the cam shaft 281. The cam 282 is eccentric about the center of the cam shaft 281 and is configured to be pivotable between a position where the cam 282 presses the upper surfaces of the movable plates 223 and 301 and a position where the cam 282 does not press the upper surfaces.

<Lateral Registration Skew Correcting Unit>

The attitude of the sheet 2 is controlled by a sheet edge detecting sensor 213, a lateral registration detecting sensor 241, and the lateral registration skew correcting unit 250 illustrated in FIG. 3. The sheet edge detecting sensor 213 is provided so as to detect the position in the conveying direction of the sheet 2 to synchronize the driving timing of the lateral registration skew correcting unit 250. The lateral registration detecting sensor 241 is provided so as to detect how much the position in the width direction of the sheet 2 being conveyed deviates from a sheet center of the puncher 200.

FIG. 11 is a diagram of the lateral registration skew correcting unit 250 when seen from the downstream side in the sheet conveying direction. An upper guide 257 and a lower guide 258 form a conveying path 266, and the active rollers 251*a* and 251*b* and the follower rollers 252*a* and 252*b* that convey the sheet 2 in the conveying path 266 are disposed. The active rollers 251*a* and 251*b* are rotated by the active roller driving motors M2 and M3 with the aid of gears 256*a* and 256*b* and 255*a* and 255*b* and roller shafts 254*a* and 254*b*, respectively.

Skew detecting sensors 253*a* and 253*b* detect the leading edge of the sheet 2 being conveyed to calculate an amount of skew from a difference in detection timing. The skew of the sheet 2 is corrected by causing the active rollers 251*a* and 251*b* to rotate at different velocities so as to cancel the amount of skew. The active rollers 251*a* and 251*b* are configured as a sheet skew correcting portion that corrects skew of the sheet 2 conveyed by the conveying roller 211.

The active rollers 251*a* and 251*b* and the skew detecting sensors 253*a* and 253*b* are mounted on the shift portion 267. The shift portion 267 has bearings 261*a* and 261*b* and is supported so as to be shifted by moving in a left-right direction of FIG. 11 along a shaft 268 which is supported by a front plate 260 and a rear plate 259 of the puncher 200.

The shift portion 267 is connected to a portion of a timing belt 263 which is rotatably stretched by pulleys 264 and 265 by a connecting portion 262. The timing belt 263 rotates with the pulley 264 that is rotated by the shift driving motor M4, and the shift portion 267 is shifted by moving in the left-right direction of FIG. 11 with the movement in the left-right direction of FIG. 11 of the timing belt 263.

<Punching Mode Operation>

Next, an operation in a punching mode of the sheet 2 will be described with reference to the flowcharts illustrated in FIGS. 12 to 15. When a user selects a punching mode using the operation portion 601 in step S1 of FIG. 12, a message is displayed to instruct the user to insert the punch unit 220 in the puncher 200 (step S2).

The user inserts the punch unit 220 in the puncher 200 (step S3). Then, the unit identification sensor 222 identifies the type of the processing unit mounted on the puncher 200 to know whether the processing unit is the punch unit 220 or the scoring unit 300 (step S4).

A processing mode selected and the type of the punch unit 220 are checked (step S5), and if the mode does not match the type, a message is displayed to instruct the user to replace with a correct type (step S6). The operations of steps S3 to S6 are repeated until a processing unit matching the selected processing mode is inserted.

When it is determined in step S5 that a processing unit matching the selected processing mode is inserted, the flow proceeds to step S7, and a window for inputting details of the mode is displayed (step S7). When a punching mode is selected in step S7, the flow proceeds to step S8 illustrated in FIG. 13 and a sheet size, a print count, and a type of sheet are selected and a punching position is input (step S9). When copying starts (step S10), printing starts.

Subsequently, a conveying motor M6 rotates and the conveying rollers 202 and 208 to 211 rotate (step S11).

When the sheet 2 is delivered from the discharge port 9 of the image forming apparatus main body 600 to the puncher 200, the entrance sensor 201 is turned ON (step S12). When a leading edge of the conveyed sheet 2 is detected by the sheet edge detecting sensor 213 (step S13), the active roller driving motors M2 and M3 rotate the active roller 251 and the follower roller 252 (step S14).

The sheet 2 is nipped by the active roller 251 and the follower roller 252. When the sheet 2 is detected by the skew detecting sensors 253*a* and 253*b* (step S15), a follower roller 211*b* is retracted from a driving roller 211*a* by a solenoid (not illustrated) and the nipping of the sheet 2 is released (step S16).

The amount of skew of the sheet 2 is calculated based on a difference in detection timing of the skew detecting sensors 253*a* and 253*b* (step S17). The skew of the sheet 2 is corrected by individually changing the conveying velocities of the active rollers 251*a* and 251*b* for a predetermined period so that the skew of the sheet 2 is cancelled (step S18).

When the skew of the sheet 2 is corrected, the conveying velocities of the active rollers 251*a* and 251*b* are changed so as to rotate at the same velocity (step S19). The lateral registration detecting sensor 241 detects a lateral edge position of the sheet 2 (step S20). A lateral misregistration amount of the sheet 2 in relation to the sheet center is measured, and the shift driving motor M4 is rotated to move the shift portion 267 at a predetermined moving velocity V1 to correct the lateral misregistration of the sheet 2 (steps S21 and S22).

In this way, the sheet position is corrected so that punch holes are formed at correct positions in the sheet width direction. When the rear edge of the sheet 2 is detected by the sheet edge detecting sensor 213 (step S23) and the sheet 2 is conveyed by a predetermined amount, the active roller 251 and the follower roller 252 stop (step S24). Moreover, the conveying rollers 208 to 211 also stop (step S25). In this way, the punch hole positions in the sheet conveying direction are determined. After that, the cam driving motor M1 is driven to make one revolution at a predetermined punching velocity V3 to perform the punching process on the sheet 2 (steps S26 and S27).

After that, a conveying motor M7 is driven to rotate the conveying rollers 206 and 214 to 216 (step S28) and to rotate the active roller 251 (step S29). The sheet 2 in which holes are formed by the punch unit 220 is delivered from the puncher 200 to the finisher 100.

A discharge sensor 207 detects completion of discharge of the sheet 2 outside the puncher 200 (steps S31 and S32). The follower roller 211*b* retracted by the solenoid (not illustrated)

returns to a nip position where the follower roller 211*b* presses against the driving roller 211*a* (step S33). Moreover, the active roller 251 stops (step S33) and the conveying motor M7 is stopped to stop rotation of the conveying rollers 206 and 214 to 216 (step S34).

In step S35, it is determined whether the present sheet is the last sheet 2. When the present sheet is not the last sheet 2, the operations of steps S11 to S35 are repeated. When it is determined in step S35 that the present sheet is the last sheet 2, the job is completed.

<Scoring Mode Operation>

Figure 12:
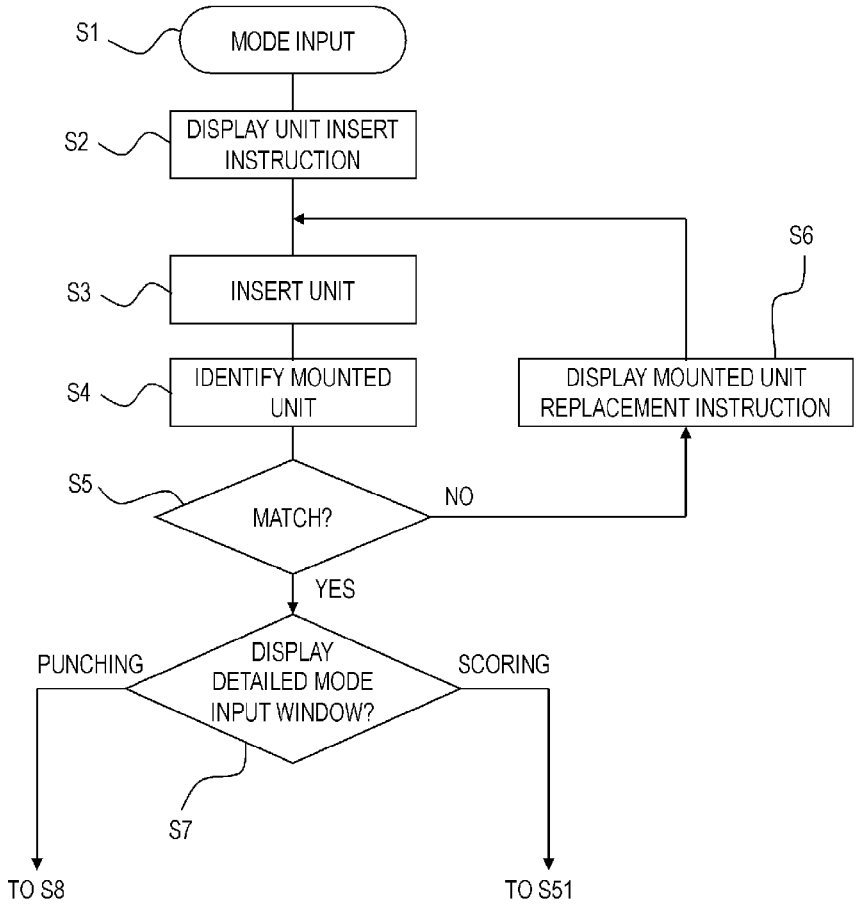
FIG. 12 is a flowchart for describing an operation of the sheet processing apparatus according to the present invention.
Figure 13:
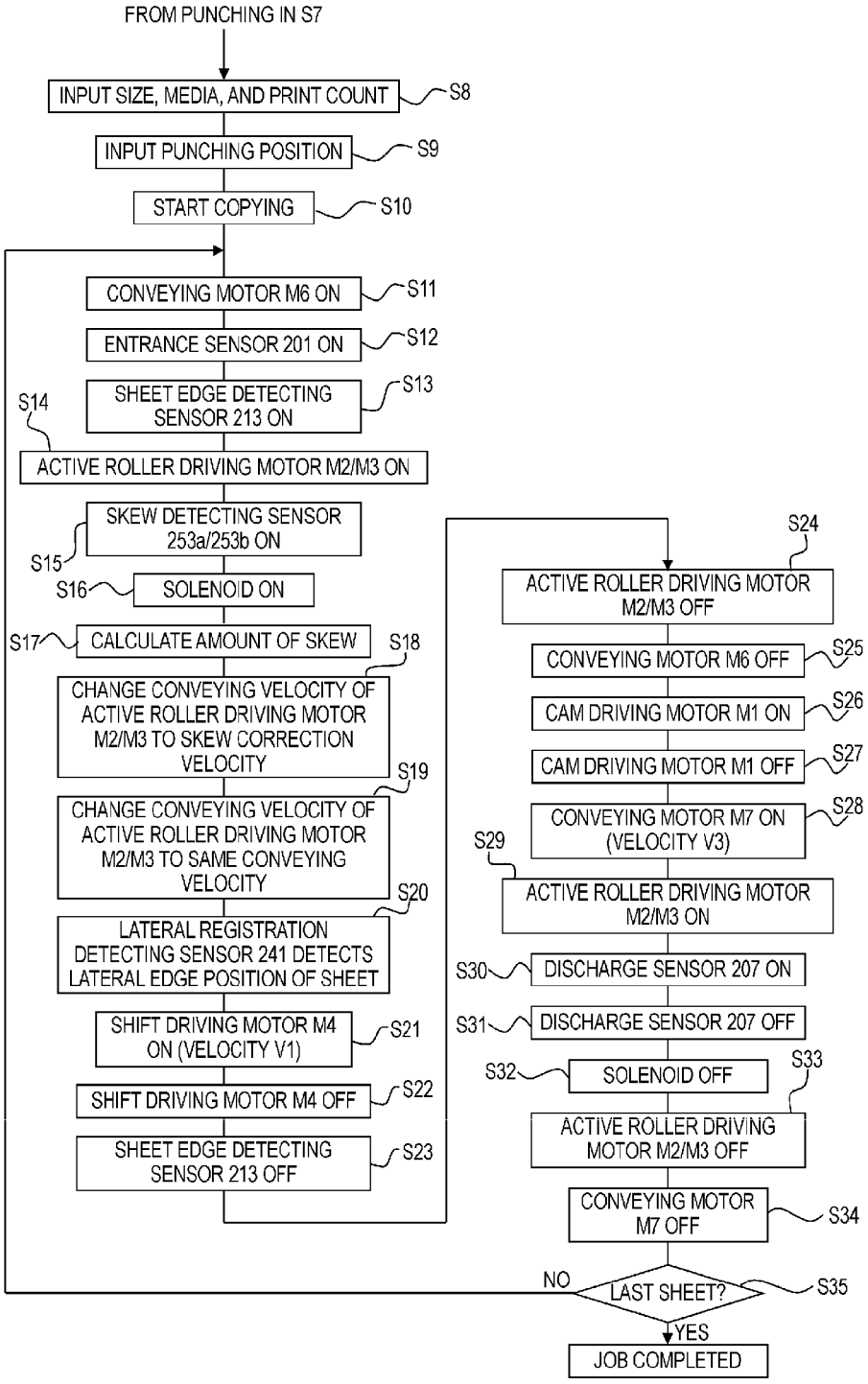
FIG. 13 is a flowchart for describing an operation of the sheet processing apparatus according to the present invention.
Figure 14:
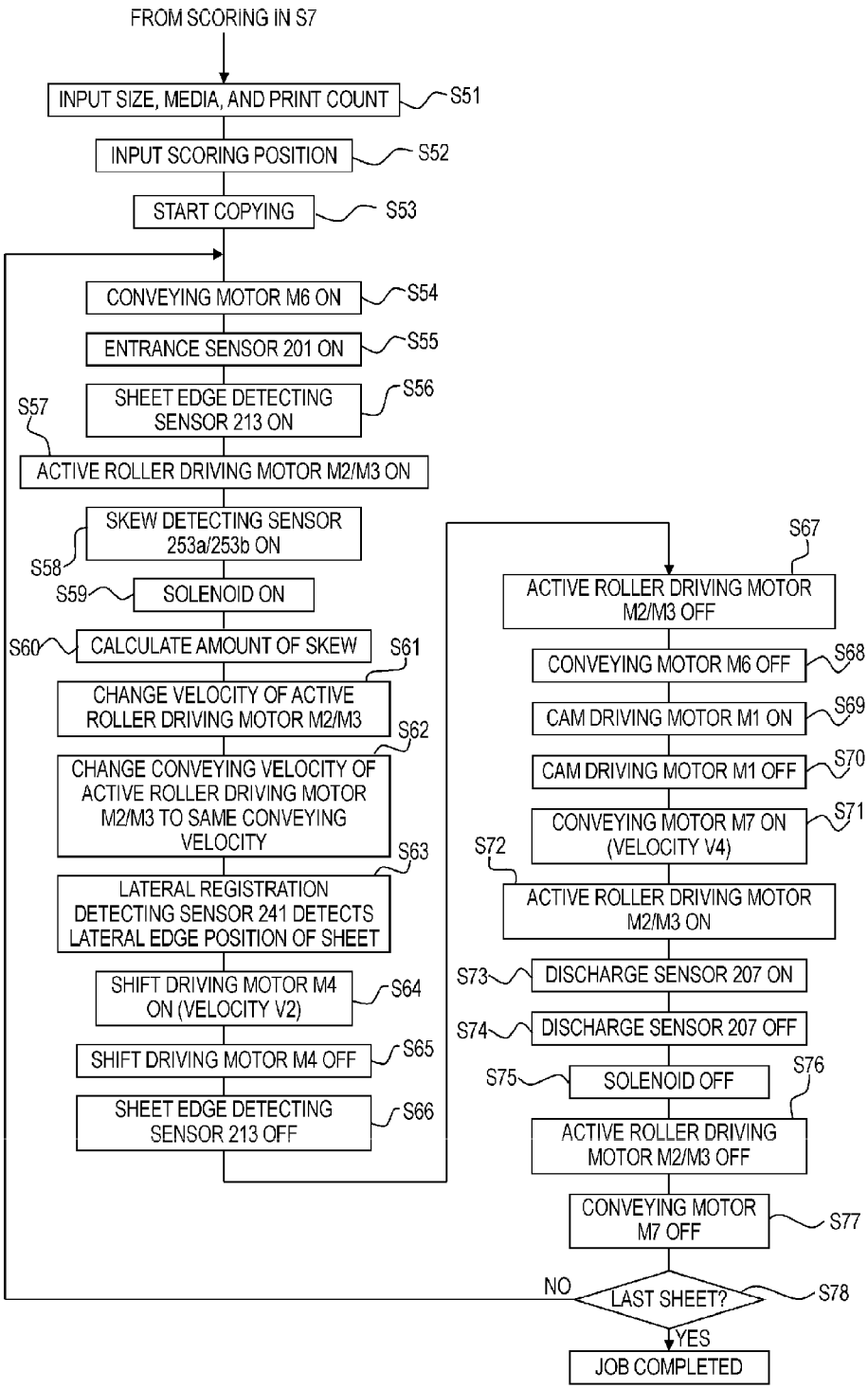
FIG. 14 is a flowchart for describing an operation of the sheet processing apparatus according to the present invention.

Next, an operation in a scoring mode of the sheet 2 will be described with reference to the flowchart illustrated in FIG. 14. Since the operations of steps S1 to S7 illustrated in FIG. 12 are the same as those described above, redundant description thereof will not be provided and the operations of steps starting with step S51 illustrated in FIG. 14 will be described. When the user selects a scoring mode using the operation portion 601 in step S1 illustrated in FIG. 12, a window for inputting details of the mode is displayed in step S7 similarly to steps S2 to S7.

Subsequently, the flow proceeds to step S51 illustrated in FIG. 14 and a sheet size, a print count, and a type of sheet are selected and a scoring position is input (step S52). When copying starts (step S53), printing starts. Subsequently, the conveying motor M6 rotates and the conveying rollers 202 and 208 to 211 rotate (step S54).

When the sheet 2 is delivered from the discharge port 9 of the image forming apparatus main body 600 to the puncher 200, the entrance sensor 201 is turned ON (step S55).

Subsequently, a leading edge of the sheet 2 conveyed by the conveying rollers 208 to 210 is detected by the sheet edge detecting sensor 213 (step S56). Then, the active roller driving motors M2 and M3 rotate the active roller 251 and the follower roller 252 (step S57).

The sheet 2 is nipped and conveyed by the active roller 251 and the follower roller 252 and is detected by the skew detecting sensors 253*a* and 253*b* (step S58). Then, the follower roller 211*b* is retracted from the driving roller 211*a* by the solenoid (not illustrated) and the nipping is released (step S59).

The amount of skew of the sheet 2 is calculated based on a difference in detection timing of the skew detecting sensors 253*a* and 253*b* (step S60). The skew of the sheet 2 is corrected by individually changing the conveying velocities of the active rollers 251*a* and 251*b* for a predetermined period so that the skew of the sheet 2 is cancelled (step S61).

When the skew of the sheet 2 is corrected, the conveying velocities of the active rollers 251*a* and 251*b* are changed so as to rotate at the same velocity (step S62). The lateral registration detecting sensor 241 detects a lateral edge position of the sheet 2 (step S63). A lateral misregistration amount of the sheet 2 in relation to the sheet center is measured, and the shift driving motor M4 is rotated to move the shift portion 267 at a predetermined moving velocity V2 higher than that of the punching mode. In this way, the lateral misregistration of the sheet 2 is corrected (steps S64 and S65).

The puncher controller 638 serving as a controller changes the operation of the lateral registration skew correcting unit 250 according to the type of the punch unit 220 and the scoring unit 300 serving as the sheet processing portion.

A lateral registration correction processing time is shortened by moving the shift portion 267 at a moving velocity V2 (>V1) higher than the moving velocity V1 during the punching mode. Since the scoring process is performed by the scoring blade 304 and the scoring groove 306 which extend in the entire area in the sheet width direction, the scoring process does not require high positional accuracy in the sheet width direction. Thus, it is possible to shorten a lateral registration correction processing time by sacrificing the positional accuracy to increase the moving velocity V2 of the shift portion 267.

When the rear edge of the sheet 2 is detected by the sheet edge detecting sensor 213 (step S66) and the sheet 2 is conveyed by a predetermined amount, the active roller 251 stops (step S67). Moreover, the conveying rollers 208 to 211 also stop (step S68). In this way, the scoring positions in the sheet conveying direction are determined. After that, the cam driving motor M1 is driven to make one revolution at a predetermined scoring velocity V4 (<V3) lower than the punching velocity V3 to perform the scoring process (steps S69 and S70).

The reason why the scoring velocity V4 is set to be lower than the punching velocity V3 is to decrease the rotating velocity of the cam driving motor M1 to increase torque because the scoring process requires larger force than the punching process. Due to this, although the scoring processing time increases, a total processing time does not increase because the lateral registration correction processing time is shortened as described above.

After that, the conveying motor M7 is driven to rotate the conveying rollers 206 and 214 to 216 (step S71). Moreover, the active roller 251 is rotated (step S72) to deliver the sheet 2 from the puncher 200 to the finisher 100. The discharge sensor 207 detects completion of discharge of the sheet 2 outside the puncher 200 (steps S73 and S74).

After that, the solenoid (not illustrated) is turned OFF so that the retracted follower roller 211*b* returns to the nip position where the follower roller 211*b* presses against the driving roller 211*a* (step S75). Moreover, the active roller 251 stops (step S76) and the conveying motor M7 is stopped to stop the conveying rollers 206 and 214 to 216 (step S77).

In step S78, it is determined whether the present sheet is the last sheet 2. When the present sheet is not the last sheet 2, the operations of steps S54 to S78 are repeated. When it is determined in step S78 that the present sheet is the last sheet 2, the job is completed.

Figure 15:
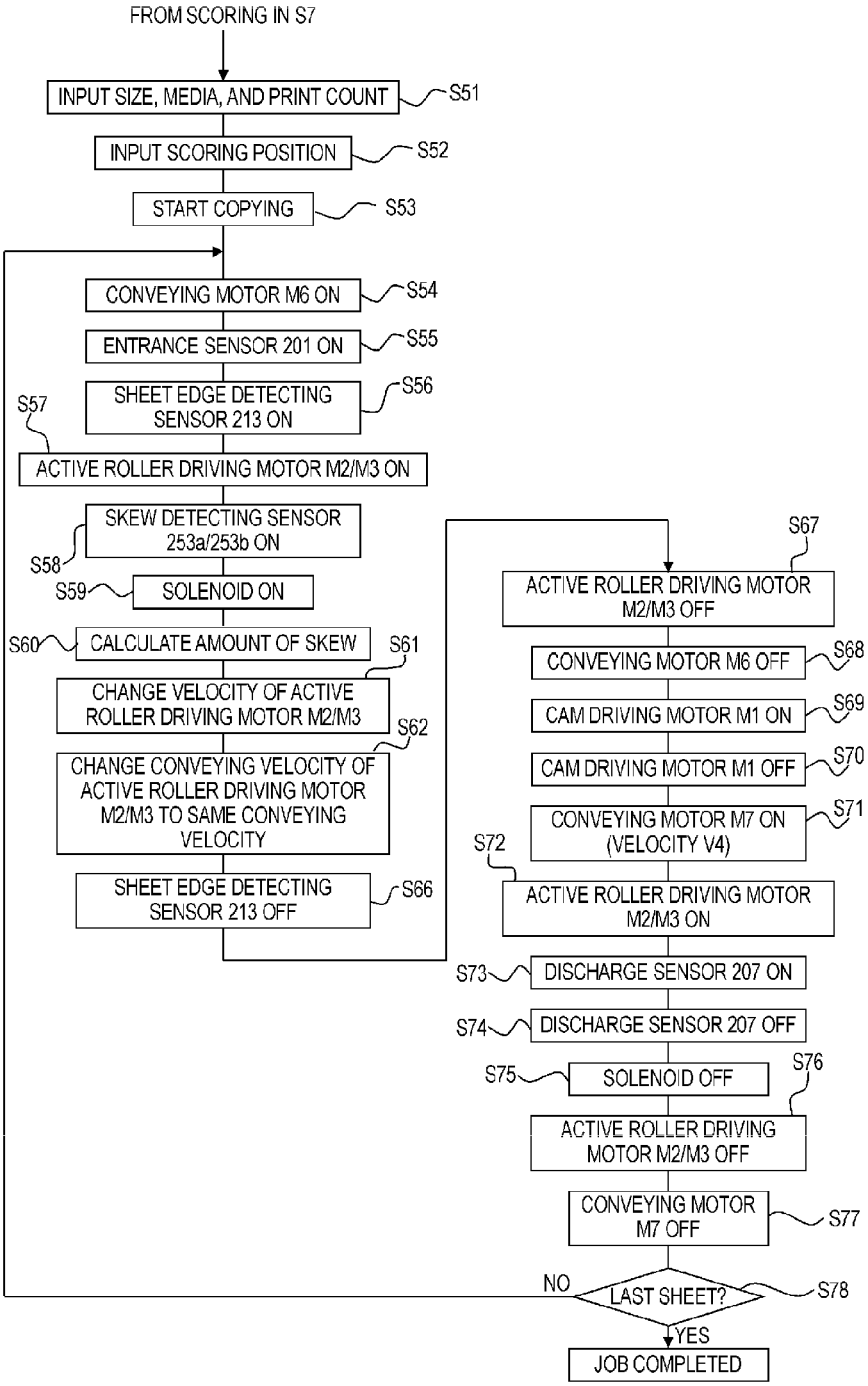
FIG. 15 is a flowchart for describing an operation of the sheet processing apparatus according to the present invention.

In the case of the scoring process, some sheet processing apparatuses have a large margin in the sheet width direction of a conveying path of the puncher 200 in relation to lateral misregistration of the sheet 2 discharged from the discharge port 9 of the image forming apparatus main body 600. In this case, as illustrated in FIG. 15, the operation of step S63 of FIG. 14 in which the lateral registration detecting sensor 241 detects a lateral edge position of the sheet 2 and the operations of steps S64 and S65 in which the shift portion 267 is moved to correct the lateral misregistration of the sheet 2 may not be performed.

In this case, the puncher controller 638 controls whether the lateral registration skew correcting unit 250 serving as the position correcting portion will be operated according to the type of the punch unit 220 and the scoring unit 300 serving as the sheet processing portion.

The puncher controller 638 operates the lateral registration skew correcting unit 250 when the sheet processing portion is the punch unit 220. On the other hand, the puncher controller 638 does not operate the lateral registration skew correcting unit 250 when the sheet processing portion is the scoring unit 300.

<Other Processing Units>

In addition to the processing units that perform the punching process and the scoring process, the processing unit includes a perforation unit 400 serving as a perforating portion that forms perforations in the sheet 2, a cutting unit 500 serving as a cutting portion that cuts the sheet 2, and a stamping unit 800 serving as a stamping portion that stamps marks on the sheet 2.

Although the perforation and cutting processes of which details will be described later require a long processing time because the processes are performed on the entire area in the sheet width direction, these processes do not require high lateral registration accuracy in the sheet width direction.

There are cases where lateral registration is not corrected with such a high accuracy. Due to this, it is possible to shorten a lateral registration correction processing time as in the scoring process. In contrast, in the case of a stamping process, it is necessary to align the stamping position in the width direction of the sheet 2 for respective sheets 2. However, since the stamping process is performed on only a portion of the sheet 2, the stamping force is small and the processing time is short.

Due to this, the stamping process requires such control as to correct the lateral registration with high accuracy as in the punching process. Although the processing mode has been described by way of the examples of the punching process and the scoring process, a stamping process may be performed instead of the punching process and a perforation process and a cutting process may be performed instead of the scoring process.

Hereinafter, the configuration of the perforation unit 400, the cutting unit 500, and the stamping unit 800 will be described with reference to FIGS. 16 to 18.

<Perforation Unit>

Figure 16:
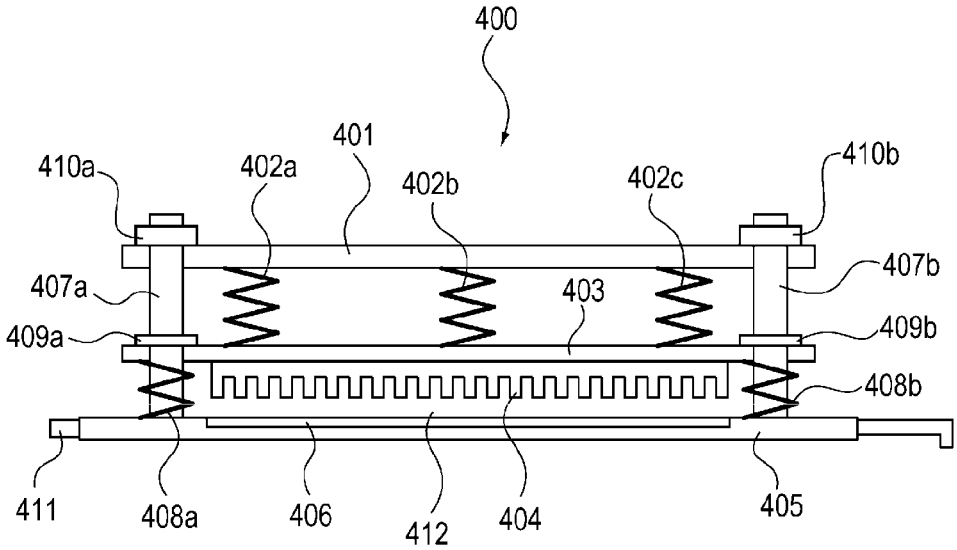
FIG. 16 is a cross-sectional explanatory view illustrating a configuration of a perforation unit of the sheet processing apparatus according to the present invention.

FIG. 16 is a cross-sectional explanatory view of the perforation unit 400 when seen from the downstream side in the sheet conveying direction. Shaft guides 407*a* and 407*b* are provided on a die plate 405, and a movable plate 401 and a blade plate 403 are supported so as to be slidable along the shaft guides 407*a* and 407*b*.

A perforation blade 404 is provided on the blade plate 403 and is configured to engage with a cutting board 406 formed of a hard rubber-like elastic body to form perforations in the sheet 2. Pressing springs 402*a* to 402*c* are provided between the movable plate 401 and the blade plate 403. The movable plate 401 is pressed by the cam 282 illustrated in FIG. 3. In this way, the blade plate 403 is pressed by extension force of the pressing springs 402*a* to 402*c*. As a result, the perforation blade 404 cuts into the cutting board 406.

Release springs 408*a* and 408*b* are springs that push up the pressed blade plate 403. A top dead point of the blade plate 403 is at a position where the blade plate 403 abuts stoppers 409*a* and 409*b*, and a top dead point of the movable plate 401 is at a position where the movable plate 401 abuts stoppers 410*a* and 410*b*. Uniform force is applied to an entire area in the sheet width direction of the perforation blade 404 when the perforation blade 404 engages with the cutting board 406.

Due to this, larger force is required for the perforation process as compared to when holes are formed in the sheet 2 sequentially by the punch blades 224*a* to 224*c* illustrated in FIG. 6. In the perforation unit 400, the type information is written and stored in the storage portion of an IC chip 411 serving as a storage portion for identifying the type of the perforation unit 400. When the unit identification sensor 222 of the puncher 200 reads the type information, it is possible to identify that the perforation unit 400 is mounted.

<Cutting Unit>

Figure 17:
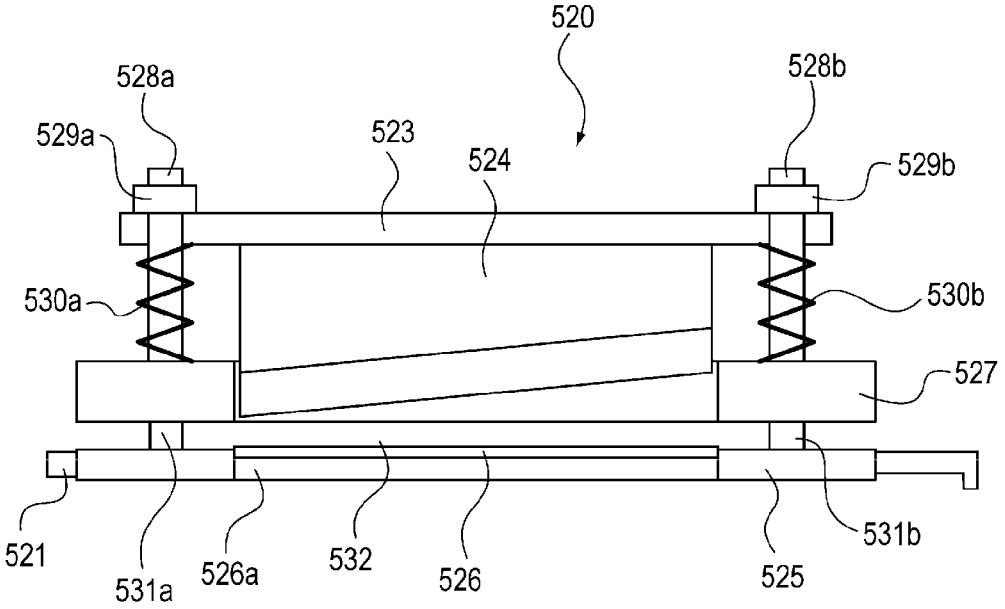
FIG. 17 is a cross-sectional explanatory view illustrating a configuration of a cutting unit of the sheet processing apparatus according to the present invention.

FIG. 17 is a cross-sectional view of the cutting unit 500 when seen from the downstream side in the sheet conveying direction. An upper cutting blade 524 is attached to a movable plate 523. A lower cutting blade 526 is attached to a die plate 525 and engages with the upper cutting blade 524 to snip off the sheet 2. The die plate 525 and a conveyance guide 527 are separated from each other with spacers 531*a* and 531*b* interposed therebetween and are in such a positional relation as to form a conveying path 532.

The movable plate 523 is supported by shaft guides 528*a* and 528*b*. When the movable plate 523 is pressed by the cam 282 illustrated in FIG. 3, the upper cutting blade 524 engages with the lower cutting blade 526 and the sheet 2 present in the conveying path 532 can be cut. Release springs 530*a* and 530*b* are springs that push up the pressed movable plate 523, and a top dead point of the movable plate 523 is at a position where the movable plate 523 abuts stoppers 529*a* and 529*b*.

A cutting edge of the upper cutting blade 524 gradually engages with the lower cutting blade 526 in the sheet width direction so that the sheet 2 is cut little by little. Since the entire area in the sheet width direction is cut little by little, the processing time increases as compared to the punching process.

In the cutting unit 500, the type information is written and stored in a storage portion provided an IC chip 521 serving as a storage portion for identifying the type of the cutting unit 500. When the unit identification sensor 222 of the puncher 200 reads the type information, it is possible to identify that the cutting unit 500 is mounted on the processing portion 8.

<Stamping Unit>

Figure 18:
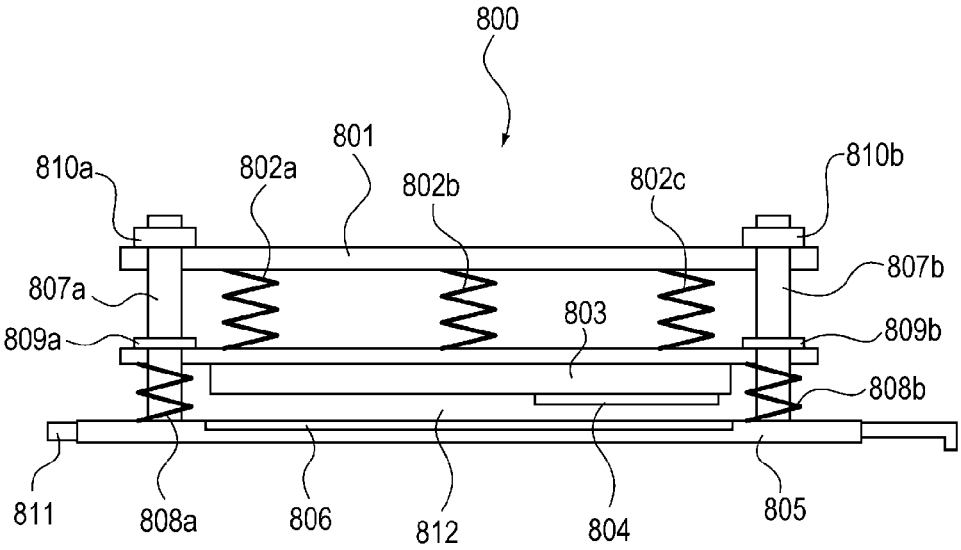
FIG. 18 is a cross-sectional explanatory view illustrating a configuration of a stamping unit of the sheet processing apparatus according to the present invention.

FIG. 18 is a cross-sectional view of the stamping unit 800 when seen from the downstream side in the sheet conveying direction. Shaft guides 807*a* and 807*b* are provided on a die plate 805, and a movable plate 801 and a blade plate 803 are supported so as to be slidable along the shaft guides 807*a* and 807*b*.

A stamp 804 is provided on the blade plate 803 and is configured to engage with a cutting board 806 formed of a hard rubber-like elastic body to stamp marks on the sheet 2. Pressing springs 802*a* to 802*c* are provided between the movable plate 801 and the blade plate 803. The movable plate 801 is pressed by the cam 282 illustrated in FIG. 3. In this way, the blade plate 803 is pressed by extension force of the pressing springs 802*a* to 802*c* and the stamp 804 cuts into the cutting board 806. As a result, marks can be formed on the sheet 2 present in a conveying path 812.

Release springs 808*a* and 808*b* are springs that push up the pressed blade plate 803. A top dead point of the blade plate 803 is at a position where the blade plate 803 abuts stoppers 809*a* and 809*b*, and a top dead point of the movable plate 801 is at a position where the movable plate 801 abuts stoppers 810*a* and 810*b*. Force is applied to the stamp 804 only when the stamp 804 engages with the cutting board 806.

Due to this, the stamping process does not require such force as large as required for the scoring process, the perforation process, and the cutting process which are performed on the entire area in the sheet width direction. In the stamping unit 800, the type information is written and stored in a storage portion provided in an IC chip 811 serving as a storage portion for identifying the type of the stamping unit 800. When the unit identification sensor 222 of the puncher 200 reads the type information, it is possible to identify that the stamping unit 800 is mounted on the processing portion 8.

As described above, the puncher controller 638 serving as a controller performs the following control. The sheet processing portion mounted on the processing portion 8 of the puncher 200 includes the punch unit 220, the scoring unit 300, the perforation unit 400, the cutting unit 500, and the stamping unit 800. The puncher controller 638 determines whether the lateral registration skew correcting unit 250 will be operated according to the type of the sheet processing portion.

For example, when the sheet processing portion mounted on the processing portion 8 of the puncher 200 is the punch unit 220 serving as a punching portion, the puncher controller 638 operates the lateral registration skew correcting unit 250. When the sheet processing portion mounted on the processing portion 8 of the puncher 200 is the scoring unit 300 serving as a scoring portion, the puncher controller 638 does not operate the lateral registration skew correcting unit 250.

When the sheet processing portion is the punch unit 220 or the stamping unit 800, the puncher controller 638 operates the lateral registration skew correcting unit 250. On the other hand, when the sheet processing portion is the scoring unit 300, the perforation unit 400, or the cutting unit 500 other than the punch unit (punching portion) 220 and the stamping unit (stamping portion) 800, the puncher controller 638 may not operate the lateral registration skew correcting unit 250.

Alternatively, the puncher controller 638 may decrease the following processing velocities to be lower than the punching velocity or the stamping velocity when the sheet processing portion is the punch unit 220 or the stamping unit 800. That is, the puncher controller 638 may decrease the respective processing velocities such as the scoring velocity, the perforation velocity, and the cutting velocity when the sheet processing portion is the scoring unit 300, the perforation unit 400, or the cutting unit 500 other than the punch unit 220 and the stamping unit 800.

Alternatively, the puncher controller 638 may increase the following moving velocities to be higher than the moving velocity of the lateral registration skew correcting unit 250 when the sheet processing portion is the punch unit 220 or the stamping unit 800. That is, the puncher controller 638 may increase the moving velocity of the lateral registration skew correcting unit 250 when the sheet processing portion is the scoring unit 300, the perforation unit 400, or the cutting unit 500 other than the punch unit 220 and the stamping unit 800.

The press driving unit 280 of the present embodiment operates the punch unit 220. The press driving unit 280 is configured as a common driving portion that drives the punch unit 220, the stamping unit 800, the scoring unit 300, the perforation unit 400, and the cutting unit 500 serving as the sheet processing portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-267107, filed Dec. 25, 2013, which is hereby incorporated by reference herein in its entirety.

What is claimed is:

1. A sheet processing apparatus comprising:

a sheet conveying portion that conveys a sheet;

a position correcting portion that corrects a position, in a width direction orthogonal to a sheet conveying direction, of the sheet conveyed by the sheet conveying portion;

a sheet processing portion that performs processing on the sheet conveyed by the sheet conveying portion; and a controller, wherein the sheet processing portion is configured to be detachably attached to the sheet processing apparatus and selected from among a plurality of types of sheet processing portions, and wherein the controller changes an operation of the position correcting portion according to a type of the sheet processing portion attached to the sheet processing apparatus.

2. The sheet processing apparatus according to claim 1, wherein the controller determines whether or not to operate the position correcting portion according to the type of the sheet processing portion.

3. The sheet processing apparatus according to claim 2, wherein when the controller determines to operate the position correcting portion, the sheet processing portion performs processing on the sheet for which position has been corrected by the position correcting portion.

4. The sheet processing apparatus according to claim 1, wherein the plurality of types of sheet processing portions includes:

a punching portion that forms holes in a sheet, and a scoring portion that cuts lines in a sheet.

5. The sheet processing apparatus according to claim 4, wherein the controller operates the position correcting portion when the punching portion is attached as the sheet processing portion, and wherein the controller does not operate the position correcting portion when the scoring portion is attached as the sheet processing portion.

6. The sheet processing apparatus according to claim 4, wherein the controller decreases a scoring velocity when the sheet processing portion is the scoring portion so as to be lower than a punching velocity when the sheet processing portion is the punching portion.

7. The sheet processing apparatus according to claim 4, wherein the controller increases a moving velocity at which the position correcting portion moves the sheet when the scoring portion is attached as the sheet processing portion so as to be higher than a moving velocity at which the position correcting portion moves the sheet when the punching portion is attached as the sheet processing portion.

8. The sheet processing apparatus according to claim 1, wherein the controller changes a moving velocity at which the position correcting portion moves the sheet according to the type of the sheet processing portion.

9. The sheet processing apparatus according to claim 1, wherein the plurality of types of sheet processing portions includes at least two of:

a punching portion that forms holes in a sheet;

a scoring portion that cuts lines in a sheet;

a perforating portion that forms perforations in a sheet;

a cutting portion that cuts a sheet; and a stamping portion that stamps marks on a sheet.

10. The sheet processing apparatus according to claim 9, wherein the controller operates the position correcting portion when the punching portion or the stamping portion is attached as the sheet processing portion, and wherein the controller does not operate the position correcting portion when another sheet processing portion other than the punching portion and the stamping portion is attached as the sheet processing portion.

11. The sheet processing apparatus according to claim 9, wherein the controller decreases a processing velocity when another sheet processing portion other than the punching portion and the stamping portion is attached as the sheet processing portion so as to be lower than a punching velocity or a stamping velocity when the punching portion or the stamping portion is attached as the sheet processing portion.

12. The sheet processing apparatus according to claim 9, wherein the controller increases a moving velocity at which the position correcting portion moves the sheet when another sheet processing portion other than the punching portion and the stamping portion is attached as the sheet processing portion so as to be higher than a moving velocity at which the position correcting portion moves the sheet when the punching portion or the stamping portion is attached as the sheet processing portion.

13. The sheet processing apparatus according to claim 1, wherein the sheet processing apparatus comprises a common driving portion that drives all types of the sheet processing portions attached.

14. The sheet processing apparatus according to claim 1, wherein the sheet processing apparatus comprises a sheet skew correcting portion that corrects skew of the sheet conveyed by the sheet conveying portion.

15. The sheet processing apparatus according to claim 14, wherein the controller allows the sheet skew correcting portion to correct skew of the sheet conveyed by the sheet conveying portion regardless of the type of the sheet processing apparatus.

16. An image forming apparatus comprising:

the sheet processing apparatus according to claim 1; and an image forming portion that forms images on a sheet.

17. An image forming apparatus comprising:

a sheet conveying portion that conveys a sheet;

an image forming apparatus that forms images on the sheet conveyed by the sheet conveying portion;

a position correcting portion that corrects a position, in a width direction orthogonal to a sheet conveying direction, of the sheet conveyed by the sheet conveying portion; a sheet processing portion that performs processing on the sheet conveyed by the sheet conveying portion; and a controller, wherein the sheet processing portion is configured to be detachably attached to the sheet processing apparatus and selected from among a plurality of types of sheet processing portions, and wherein the controller changes an operation of the position correcting portion according to a type of the sheet processing portion attached to the sheet processing apparatus.

* * * * *